United States Patent [19]

Tyree, Jr.

[11] 4,224,801

[45] Sep. 30, 1980

[54] STORED CRYOGENIC REFRIGERATION

[76] Inventor: Lewis Tyree, Jr., 145 Briarwood Ave., N., Oak Brook, Ill. 60521

[21] Appl. No.: 959,891

[22] Filed: Nov. 13, 1978

Related U.S. Application Data

[63] Continuation-in-part of Ser. No. 737,440, Nov. 1, 1976, Pat. No. 4,127,008.

[51] Int. Cl.[2] ..... F17C 7/02

[52] U.S. Cl. ..... 62/48; 62/168; 62/332

[58] Field of Search ..... 62/45, 47, 48, 62, 332, 62/514 R, 165, 166, 168

[56] References Cited

U.S. PATENT DOCUMENTS

| | | | |
|---|---|---|---|
| 2,229,438 | 1/1941 | Birdsall | 62/47 |
| 2,404,511 | 7/1946 | Maclean | 62/10 |
| 2,496,185 | 1/1950 | Voss et al. | 62/46 |
| 3,788,091 | 1/1974 | Miller | 62/332 |
| 3,810,365 | 5/1974 | Hampton et al. | 62/48 |
| 3,906,742 | 9/1975 | Newton | 62/332 |
| 3,933,001 | 1/1976 | Muska | 62/47 |
| 3,994,141 | 11/1976 | Schräwer | 62/48 |

*Primary Examiner*—Ronald C. Capossela
*Attorney, Agent, or Firm*—Fitch, Even & Tabin

[57] ABSTRACT

A holding chamber may be supplied from a storage vessel system with a cryogen, such as liquid $CO_2$, or it may itself be large enough to take the place of a separate storage vessel. The temperature within the holding chamber is reduced to the triple point or below to form a refrigeration reservoir of solid cryogen, as by removing vapor from the chamber to cause evaporation or by employing mechanical refrigeration. The stored cooling power of the reservoir is later employed to meet a large or a periodic refrigeration demand and is thereafter replenished over a number of hours, preferably during a period of non-peak electric demand. This storage principle can be incorporated into a variety of different refrigeration systems. For example, a $CO_2$ storage system may be used to produce and store solid $CO_2$ during a period of low demand upon a coupled mechanical refrigeration system; thereafter, the solid $CO_2$ is used to supplement the mechanical system during a high-demand period, thereby increasing the effective refrigeration capacity of the mechanical system.

31 Claims, 6 Drawing Figures

180
186
188c
184c
182c
188b
184b
182b
188a
184a
182a
CONTROL SYSTEM
191
248
250
214
212
222
216
210
218
208
217
219
220
224
196c
246
226
189
192c
196a
192a
190c
196b
236
238
RL
194a
190a
234
200
192b
190b
232
194b
198
230
206
242
206a
NH3
204
202

STORED CRYOGENIC REFRIGERATION

This application is a continuation-in-part of my copending patent application Ser. No. 737,440, filed Nov. 1, 1976, now U.S. Pat. No. 4,127,008.

The present invention relates to cryogenic refrigeration and more particularly to systems for utilizing cryogenic refrigeration to meet varying refrigeration load demands over a 24-hour period.

Small and intermittent users of freezing equipment, particularly in the food industry, often produce a relatively large batch of product which the processor will then wish to quick-freeze at one time. Mechanical freezers are not generally economically suitable for intermittent, relatively large-scale, fast-freezing operations requiring a relatively low temperature environment, for example, −30° F. or −40° F., because they require a large capital investment as well as provision for a high amount of short-term power. Cryogenic fast-freezing can be of significant benefit to such users, and examples of cryogenic freezing units are set forth in my prior U.S. Pat. Nos. 3,660,985, 3,672,181, 3,754,407 and 3,815,377. Heretofore, cryogenic freezing systems have generally accommodated such an intermittent high-level requirement by the expenditure of a substantial amount of cryogen, which has diminished the attractiveness of cryogenic freezing for such potential users.

In addition, there are many other situations where the demand for refrigeration will vary substantially, especially over a 24-hour period, because there will be periods of heavy demand, followed by periods of much lower demand, as well as times when there may be no need at all for refrigeration. There are also many freezing and/or cooling operations which presently employ mechanical refrigeration systems that could benefit significantly from the availability of cryogenic temperatures. The adaptation of cryogenic refrigeration systems to fulfill such needs would provide a commercially attractive alternative for and/or supplement to refrigeration systems existing today.

One object of the present invention is to provide a carbon dioxide cooling system which can intermittently supply a relatively large quantity of cryogenic refrigeration on an economically attractive basis. Another object is to provide improved methods of cryogenic freezing, capable of handling intermittent, relatively large refrigeration demands, which are efficient and economically attractive. A further object is to provide a carbon dioxide system which can be added to an existing mechanical refrigeration system for a relatively low capital expenditure, that will increase the efficiency and capacity of the overall system as well as provide cryogenic freezing temperatures, if desired. Still another object is to provide a system which is capable of providing cryogenic cooling temperatures without expeniture of cryogen and which can significantly reduce capital cost because it is capable of providing three or more times as much short-term refrigeration capacity, compared to a standard system using compressors and condensers of similar size.

These and other objects of the invention will be apparent from the following detailed description of the preferred embodiments of the invention when read in conjunction with the accompanying drawings wherein.

Very generally, a relatively large amount of refrigeration at cryogenic temperatures can be supplied on an intermittent basis, by establishing a low-temperature coolant reservoir of slush or snow which can be economically created during a time period when there is low usage, at night or during other "off" periods. Build-up of refrigeration capacity in the reservoir can be accomplished relatively slowly, requiring only fairly low power demands and relatively small capacity equipment. Although any suitable cryogen may be used, it appears that the invention has particular advantages when the cryogen has a triple point between about −30° F. and about −80° F., and the preferred cryogen is carbon dioxide.

When the need for refrigeration arises, cold liquid carbon dioxide can be supplied at whatever rate is necessary while taking advantage of the immediate availability of capacity of the low-temperature reservoir to assist in removing the absorbed heat from a fluid stream returning to the reservoir. If $CO_2$ vapor is generated and returned, the latent heat absorption capacity of the solid $CO_2$ is available for cooling, either directly or indirectly, and condensing $CO_2$ vapor. As a result, for example, a large amount of product can be fast-frozen in a relatively short period of time while recovering all the vaporized cryogen. When a period of peak use is followed by one of no or only low usage, operation of a relatively low capacity compressor and condensor is effective to regenerate the low-temperature coolant reservoir for another freezing cycle. The sizing of reservoirs, compressors and condensers and the like can be arranged as desired for different cycles, and more than a single unit may be employed in a system when design conditions so dictate.

Figures 1, 2:
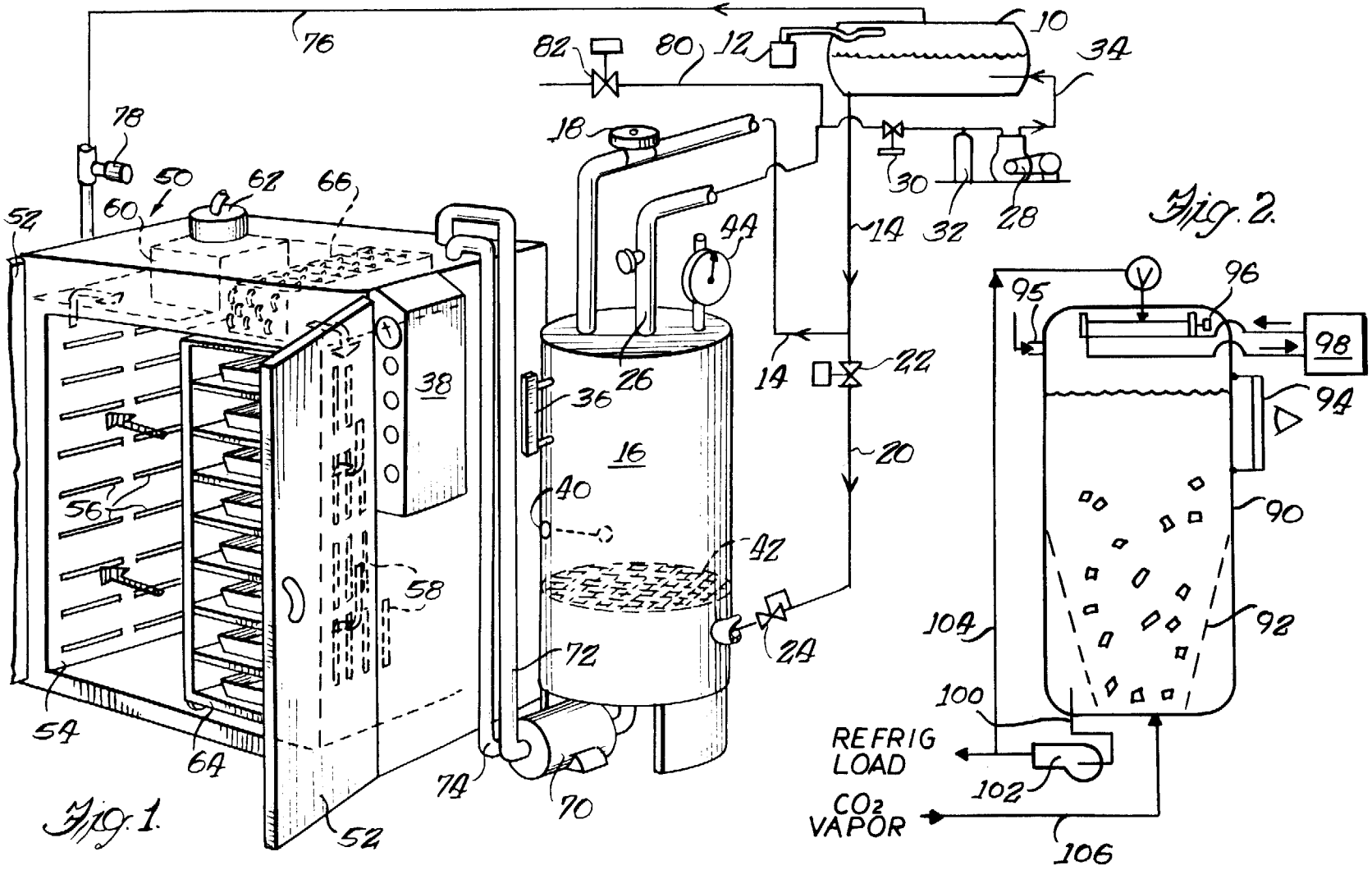
FIG. 1 is a diagrammatic view of a carbon dioxide cooling system embodying various features of the invention.
FIG. 2 is a fragmentary view of an alternative arrangement for a portion of the system illustrated in FIG. 1.

One arrangement for providing intermittent cooling to a specialty food service operation or the like, which embodies certain features of the invention, is depicted in FIG. 1. A standard carbon dioxide liquid storage vessel 10 is employed which is designed for the storage of liquid carbon dioxide at about 300 p.s.i.g., at which pressure it will have an equilibrium temperature of about 0° F. A refrigeration unit 12, such as a freon condenser, is associated with the storage vessel 10 and is designed to operate as needed to condense carbon dioxide vapor in the vessel to liquid. The freon condenser is a standard item, and one is employed with a sufficient condensation capacity to match the size of the tank and the intended operation for utilization of the liquid carbon dioxide. A typical condenser for an installation of this type may be rated to condense about fifty pounds of carbon dioxide vapor an hour at 300 p.s.i.g.

A liquid line 14 extends from the bottom of the storage vessel 10 to an upper portion of a chamber or holding tank 16 via a remotely operable valve 18. If desirable because of the length of piping run from the storage vessel, a pump (not shown) may be included in the liquid line 14. A branch line 20 is connected to the liquid line 14, and it enters at a lower location on the tank 16 via a remote-controlled valve 22 and a pressure regulator 24. The pressure regulator assures that the pressure in the line does not drop below about 80 p.s.i.a.

A vapor line 26 extends from the upper portion of the tank 16 to the intake side of a compressor 28. Connected in the vapor line 26 are a remotely-operable valve 30 and an accumulator 32, which are used for a purpose to be explained hereinafter. A line 34 extends from the discharge of the compressor 28 to a location near the bottom of the interior of the storage vessel 10 so that the warmed, high pressure gas is bubbled into the liquid carbon dioxide in the storage vessel. In this manner, the body of liquid carbon dioxide acts as a thermal flywheel or "de-superheater", and the freon refrigeration unit 12 is utilized to carry out the reliquification of the high pressure vapor.

The holding tank 16 is equipped with a liquid level control 36 which is electrically linked to a remote control panel 38. Once the desired liquid level within the tank 16 is reached, the control circuitry operates to cause the valve 18 to close. The compressor 28 can run, if desired, during filling to remove vapor from the tank 16 in order to reduce the pressure of the liquid $CO_2$ from the initial high pressure at which it was supplied from the storage tank (e.g., 300 p.s.i.g.) to at least as low as the triple point, i.e., about 75 p.s.i.a. It may momentarily be reduced to a slightly lower pressure. Lowering the pressure results in vaporization, cooling the unvaporized liquid $CO_2$, and dropping the temperature of the liquid carbon dioxide in the holding tank.

The liquid level within the holding tank 16 continuously decreases as a result of such vaporization, and if it reaches the lower level set on the controller 36, a signal to the control system 38 would result in opening the valve to supply additional liquid $CO_2$ into the tank through the upper line 14 so long as the pressure in the tank as measured by the monitor 44 is above a present value, e.g., 75 p.s.i.a. Some of the higher pressure liquid being supplied will immediately vaporize and cool the remainder, and filling continues until the desired upper liquid level is reached.

When the temperature reaches about −69.9° F., solid $CO_2$ begins to form as vaporization continues. A layer of solid $CO_2$ may first form near the upper surface of the liquid in the tank; however, the density of solid $CO_2$ is greater than that of liquid $CO_2$ so it has a tendency to sink. By interrupting the suction of the compressor 28 on the tank, vaporization may be momentarily halted to allow the solid $CO_2$ layer to sink below the surface. Resumption of the suction by the compressor 28 can result in the formation of another solid layer which can be allowed to sink during a subsequent interruption. Repeated sucking and interrupting may be used to build up a reservoir of slush within the holding tank 16.

To avoid stopping and starting the compressor 28 to create these interruptions, momentary interruptions, for example, of about fifteen seconds are more expediently accomplished by closing the valve 30 in the vapor line and allowing the compressor to suck on the empty chamber 32 which thus serves as an accumulator. The control system may be set to begin such interruptions after a predetermined temperature or pressure is reached in the reservoir within the tank, as monitored by a temperature sensor 40 or by a pressure gauge and monitor 44, but of course the actual times would be dependent upon the size of the compressor and of the slush tank. For example, once about −69.9° F. or about 75 p.s.i.a. is reached, which is indicative that solid $CO_2$ is beginning to be formed, the control system 38 may be programmed to close the valve 30 for about fifteen seconds after every three or four minutes of operation to repeatedly form relatively thin layers of solid $CO_2$ which sink down until reaching the level of a screen 42, that is located a slight distance above the tank bottom. Mechanical, sonic and fluid flow methods of promoting mixing of the solid $CO_2$ to create slush are also acceptable.

Once slush-making has begun so that the compressor is maintaining the pressure at about the triple point of the cryogen and the lower level of liquid in the tank is again reached so that the level controller 36 calls for more liquid, the control system 38 may be set so as to allow no further liquid input or only a limited further amount. If it is decided to supply some further liquid $CO_2$, the valve 22 leading to the branch line 20 may be opened to fill the tank from the bottom and assure good mixing of the warmer liquid occurs. The liquid $CO_2$ entering the tank through the branch line 20 passes through the pressure regulator 24, the purpose of which is to prevent any solid $CO_2$ formation upstream in the region of the valve 22. By filling the tank 16 via the bottom line 20, there is no need to interrupt the slushing process.

The repetition of these operations may be employed to build up a low-temperature reservoir of carbon dioxide slush in the tank 16 which is then available for cooling or freezing needs. Ideally, the system is sized so that the region of the tank above the screen 42 becomes substantially filled with slush to the desired level during a rest period when the user is preparing the food products to be frozen. If there should be some delay in the preparation of the products, the control system 38 is designed to detect conditions indicating achievement of the desired level of slush and to halt the operation of the compressor before the entire reservoir is transformed to solid $CO_2$. For example, if a temperature of about −70° F. is monitored while the liquid level shows a substantially full condition and the pressure within the upper portion of the tank decreases below the triple point, it is an indication of formation of a fairly thick layer of solid $CO_2$ at the top of the reservoir, in which instance vaporization should be halted by shutting down the compressor.

Once such a low-temperature reservoir has been established, use can be made of it in several different ways in effecting the freezing or cooling of the product, depending upon the choice of system the customer or user selects. In the embodiment illustrated in FIG. 1, a refrigeration enclosure is provided in the form of a freezer cabinet 50 having a pair of outwardly swinging insulated front doors 52. The cabinet 50 has a layer of thermal insulation, for example, polyurethane foam, lining the interior of its rear and side walls and the top and bottom, and it is provided with an inner liner 54 that defines the enclosure wherein the product is placed that is to be frozen.

The liner 54 has a plurality of horizontally extending exit slots 56 in one wall and a plurality of vertically extending entrance slots 58 in the opposite wall through which a circulation of gas can be effected. The liner 54 is appropriately spaced from the insulated side walls and top walls of the cabinet 50 so as to provide a plenum chamber or passageway system through which a flow of air or gas can be continuously circulated by a fan or blower 60, which is driven by an electric motor 62 mounted atop the cabinet. The illustrated enclosure is designed to accommodate a pair of wheeled carts 64 carrying racks of food products which have just been prepared and are ready for quick-freezing. The control panel 38 is conveniently located in a box mounted on the side of the cabinet 50.

Cooling of the enclosure within the confines of the insulated outer walls is effected by an extended surface heat exchanger 66 that is located between the insulated top of the cabinet and the upper wall of the liner 54. The blower 60 causes the atmosphere within the enclosure to be drawn outward through the horizontal exit slots 56 and up to the fan, whence it is pushed through the extended surface of the heat exchanger 66, where it is cooled, then down through the passageway outside the opposite wall, returning to the enclosure via the vertical slots 58, and finally horizontally across the refrigeration enclosure, thereby cooling the food products carried by the carts.

In the FIG. 1 embodiment, low temperature liquid $CO_2$ is withdrawn from the bottom of the holding tank 16 and pumped by a suitable pump 70 through the heat exchanger 66 via the insulated line 72. After flowing throughout the length of the tubing which constitutes the liquid side of the heat exchanger, it exits the refrigeration cabinet 50 via the insulated line 74 and is returned to the tank at a location just below the screen 42. As a result, the approximately −70° F. liquid $CO_2$ being pumped through the tubing which carries the extended surface of the heat exchanger 66 may be and preferably is at least partially vaporized, as it takes up heat from the gaseous atmosphere being circulated therepast by the blower 60.

As the warm fluid mixture returns through the line 74 to the holding tank 16, it enters near the bottom and mixes with the cold slush as it attempts to rise in the tank, condensing the vapor and lowering the temperature of the warmed liquid $CO_2$ to the temperature of the slush reservoir, i.e., about −70° F. As a result, the refrigeration system is capable of being able to fairly promptly circulate a gaseous atmosphere at about −60° F. across the food products to be frozen. Thus, the advantages of cryogenic freezing are obtained within the refrigeration enclosure without expending carbon dioxide by exhausting it to the atmosphere. The heat given up by the warmer returning liquid and the condensing vapor is absorbed by the latent heat of the solid portion of the slush as it melts to form additional liquid cryogen. Thus, the previously established slush reservoir provides a large amount of ready cooling at cryogenic temperatures which can be employed to directly or indirectly to effect fast-freezing.

Usually, the control system 38 will be set so as to actuate the compressor 28 (if it is not already operating) as soon as the product to be frozen is loaded into the refrigeration cabinet 50, the doors 52 locked shut, and the blower motor 62 and pump 70 begin to run. In this manner, the compressor 28 begins working in anticipation of the vapor which will soon be forthcoming. Should the product itself be at all susceptible to flavor deterioration by oxidation or should even faster freezing be desired, a vapor connection between the cabinet 50 and the storage vessel 10 is made via the line 76. In this situation, before the control system actuates the blower motor 62, a valve 78 in the line 76 is automatically opened to flood the enclosure with carbon dioxide vapor which substantially displaces the air therefrom. The freezing process is then carried out using the denser (compared to air) carbon dioxide vapor which has excellent heat capacity characteristics, as well as preventing flavor deterioration. Should the special effects of another gaseous atmosphere be desired, it could be introduced into the enclosure instead of introducing the $CO_2$ vapor.

The system is designed to provide cryogenic freezing temperatures under conditions which allow recovery of substantially all of the carbon dioxide vapor, while at the same time requiring only minimal capital requirements because use is made of both a relatively low horsepower compressor and condenser. Should additional cooling capacity be needed, as for example, if on a particular day the user wishes to freeze more than the normal amount of product causing the period during which the low temperature slush reservoir is regenerated to be cut short, such additional freezing can be accomplished. A vent line 80 from the holding tank 16 is equipped with a remotely operable valve 82 that can be opened via the control panel. Accordingly, should the reservoir in the tank rise above a pre-set temperature, e.g., −60° F. or a pre-set pressure, e.g., about 95 p.s.i.a., during a time period when the pump 70 is pumping liquid carbon dioxide and the compressor 28 is operating, the control system 38 will sense that the low-temperature coolant reservoir has been substantially depleted and that the compressor 28 alone is unable to keep up with the demand for freezing capacity.

Figure 3:
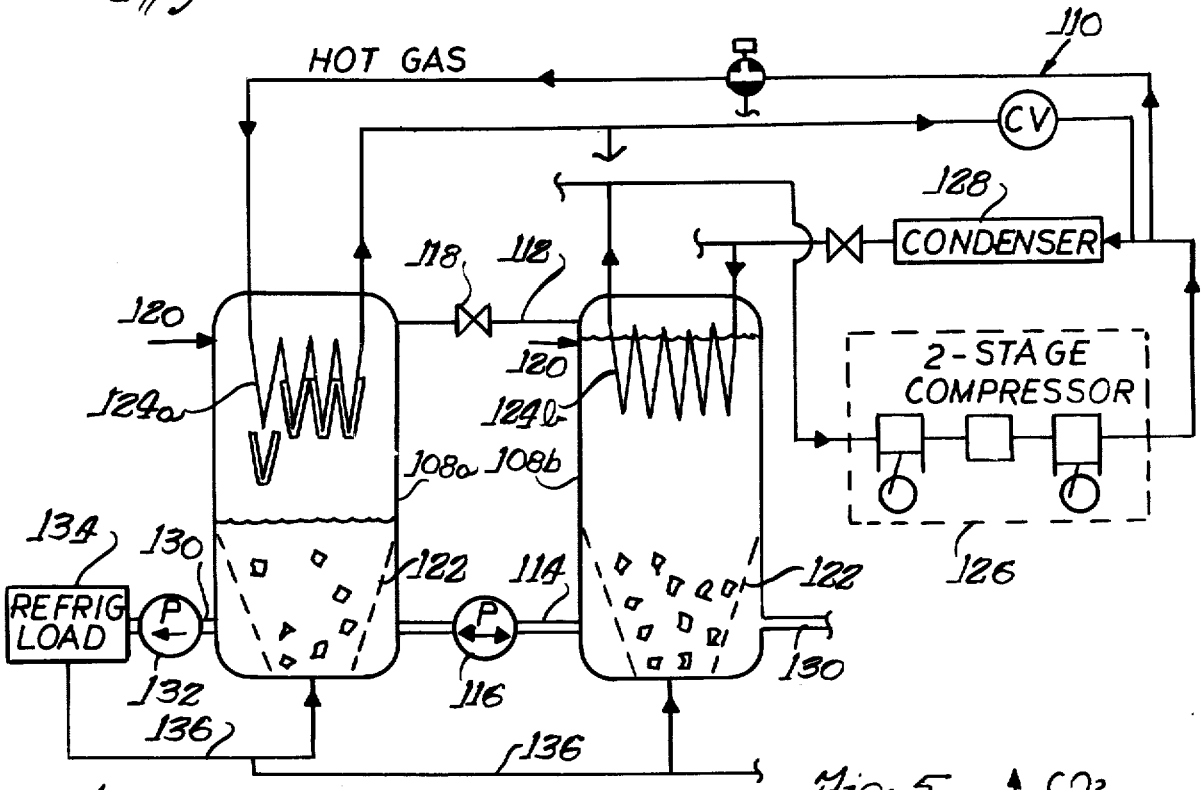
FIG. 3 is a view similar to FIG. 2 of still another alternative arrangement.

FIGS. 2 and 3 depict alternative systems for utilizing mechanical refrigeration to directly form the slush within the tank. In the FIG. 2 embodiment, a holding tank 90 is provided which has a generally frustoconical screen 92 which assures a solid-free zone adjacent the wall of the holding tank from which liquid cryogen, preferably $CO_2$, can be withdrawn. The tank 90 contains a liquid level control 94 and liquid cryogen is supplied to the tank through an inlet 95 to provide the desired level. A vapor return line (not shown) would normally be employed. Depending upon the source of the liquid $CO_2$ supply, a separate vapor condenser, for example, a freon condenser (not shown), as the tank 90 might be made much longer than the tank 16 and serve the dual function of a $CO_2$ storage vessel.

Disposed in the upper portion of the holding tank above the liquid surface is a dump-type ice-maker 96 of the type generally known for making water-ice cubes. It is adapted to lower the temperature of liquid $CO_2$ below the freezing point, i.e., about −70° F. Accordingly, the ice-making device utilizes a refrigerant which will vaporize at a somewhat lower temperature, for example, between about −75° F. and −85° F. For example, a mechanical refrigeration system 98 utilizing a freon can be used to provide temperatures in this range in the ice-maker. This mechanical refrigeration system 98 would of course include a suitable compressor and condenser which would be located outside of the holding tank in combination with a suitable expansion valve.

An outlet line 100 from the solid-free region of the holding tank 90 leads to the refrigeration load, which may be a refrigerator cabinet or the like, and an auxiliary pump 102 may be included in this line 100. A branch 104 of this line leads to the ice-making device 96. Accordingly, the standard control system for the ice-maker 96 would allow a sufficient amount of liquid $CO_2$ to be pumped into the ice-maker, and thereafter, the mechanical refrigeration system 98 would supply sufficient compressed freon through the expansion valve to freeze the liquid in the ice-maker and form solid $CO_2$. Once freezing is completed, the ice-making device 96 would be automatically actuated to run through its normal ejection cycle, as for example, by briefly passing hot gas from the compressor through the freezing coils to loosen the solid $CO_2$ therefrom, and then cause the motor to dump the solid $CO_2$ into the underlying liquid which is at substantially the triple point pressure and temperature. The ice-making cycle is then repeated until the desired percentage of solid cryogen has been created in the holding tank.

The holding tank 90 is thermally insulated and functions in the same manner as the holding tank 16 described in FIG. 1. When $CO_2$ vapor from the freezing cabinet is returned to the bottom of the holding tank through a vapor return conduit 106, the vapor and the warmer liquid rise through the slush, condensing the vapor and melting some of the solid $CO_2$ therein.

Depicted in FIG. 3 is an alternative slush-making apparatus which utilizes a pair of inter-connected tanks 108 together with a mechanical refrigeration system 110 which may be one similar to that just described. In this arrangement a pair of thermally insulated holding tanks 108 are provided which are interconnected by conduits 112,114 top and bottom. A reversible pump 116 is provided in the bottom conduit 114, and a suitable valve 118 is provided in the top conduit. The holding tanks 108 are filled to the desired level with liquid $CO_2$ which is at or near the triple point through suitable inlet pipes 120. Suitable vapor outlets (not shown) would also be provided in each tank 108.

By operating the pump 116 in the lower conduit liquid $CO_2$ can be pumped in either direction between the tanks 108 to achieve the desired liquid level therein with vapor flowing in the opposite direction through the valve 118 in the upper connecting pipe. A similar annular screen 122 to that earlier described would also be provided in each tank 108 to prevent solid $CO_2$ from reaching and perhaps clogging the pump. An ice-making device 124 is provided in the upper portion of each of the holding tanks having an extended coil surface, which may be, for example, in the shape of a number of Vs.

The pump 116 is operated to pump liquid $CO_2$ between the tanks 108 to alternately immerse the coils in the upper region of one of the tanks 108. In FIG. 3, liquid $CO_2$ has been pumped from the left-hand holding tank 108*a* to the right-hand holding tank 108*b* so that the extended coil surface 124*b* is immersed to the desired depth. Immediately thereafter, the mechanical refrigeration system 110 is caused to supply cold liquid refrigerant, as for example, a freon at a temperature of about −80° F., to the coil 124*b* which causes a thick layer of solid $CO_2$ to build up on the exterior surface thereof. The mechanical refrigeration unit 110 can be operated for a timed cycle, or some other way of measuring the thickness of the ice well known in water ice-making devices can be employed. Thereafter, the pump 116 is reversed to withdraw liquid $CO_2$ from the right-hand holding tank 108*b* and pump it into the left-hand holding tank 108*a* until the coils 124*a* near the upper end thereof are immersed.

During the time solid $CO_2$ is being formed in one tank 108*b*, the mechanical refrigeration system 110 is employed to harvest the solid $CO_2$ from coils in the upper portion of the other holding tank. In this respect, hot vapor from the compressor unit 126, which is illustrated as a two-stage reciprocating compressor, is diverted from the condenser 128 and fed through the coils 124*a* in the right-hand holding tank. This causes the solid $CO_2$ to break loose from the coils, fall to the surface liquid below and sink therein to add to the slush reservoir.

Each of the holding tanks 108 can be provided with a liquid outlet 130, and in the illustrated embodiment, the left-hand holding tank 108*a* has its outlet 130 leading to a pump 132 that supplies to cold liquid cryogen to one refrigeration load 134, such as a refrigeration cabinet. If the right-hand holding tank 108*b* has a similar outlet 130, liquid might be pumped through it to a different refrigeration load. On the other hand, the same refrigeration load could be selectively fed from either holding tank with withdrawal preferably being made from the tank 108 wherein ice-making is not currently progressing. Likewise, a vapor return line 136 would be provided leading to the lower portion of each tank 108, and these lines 136 could be cross-connected as shown. The illustrated embodiment is efficient because ice-making can take place in one holding tank while ice is being removed from the coils 124 in the other tank. Preferably, the tanks 108 are of fairly high capacity so that they can accommodate a fairly large volume of liquid slush and conceivably could serve as a $CO_2$ storage vessel to supply several refrigeration loads.

Figure 4:
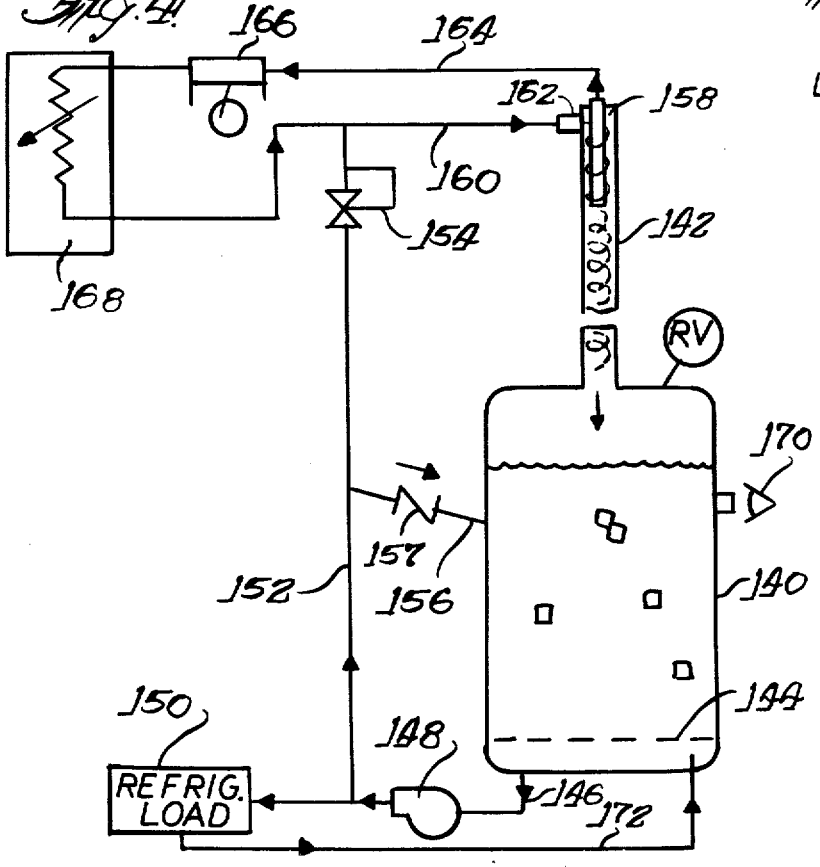
FIG. 4 is a view similar to FIG. 1 of yet another alternative embodiment.

Depicted in FIG. 4 is another alternative version of slush-making apparatus which can be employed to create a reservoir of cryogenic refrigeration. Illustrated is a large thermally insulated tank 140 which serves the dual function of both a slush-holding tank as well as a carbon dioxide storage vessel. The tank 140 might be some 10 to 12 feet in height and is surmounted by a tower 142 that might be as tall as 120 feet high. A suitable screen 144 is provided in the lower portion of the tank 140 to assure a solid-free zone from which liquid $CO_2$ may be withdrawn through a line 146. A circulating pump 148 is provided in the line 146. Downstream of the pump, the line 146 may lead to one or more refrigeration loads 150, and a branch line 152 is provided which leads upward to the tower 142 through a pressure-regulator 154. A bypass line 156 containing a check valve 157 leads from the branch line 152 back to the upper portion of the main tank 140. The check valve 157 is sized so that, when the pump 148 is operating, there will be a flow of liquid through the bypass line 156 that creates a downward current within the large main tank 140 to assist the downward settling of the solid $CO_2$ therein.

A centrifugal separating device 158 is provided at the upper end of the tower 142, and the liquid $CO_2$ from the line 152 flows through a line 160 leading to an expansion nozzle 162 which enters the separating device in a non-radial direction. The pressure at the top of the tower 142 is sufficiently low that the liquid $CO_2$ passing through the expansion nozzle 162 is transformed into a mixture of vapor and solid cryogen particles or snow. The $CO_2$ snow travels in a swirling motion along the outer surface of the tower section whereas the vapor flows upward through an interior concentric tube and out the top of the tower 142 through a line 164.

A compressor 166 is provided to withdraw vapor from the top of the tower through the line 164 and increase its pressure. The heated vapor leaving the compressor 166 is passed through a freon condenser 168 or the like which lowers the temperature sufficiently to liquify it following this increase in pressure, and this liquid is then directed to a tee where it joins the liquid being pumped through the pressure regulator 154 and flows to the expansion nozzle 162. Thus, the line 152 also serves as a make-up line to deliver an amount of liquid $CO_2$ about equal to the amount which turns to solid at the nozzle. The pressure regulator 154 may be set to maintain a downstream pressure of, for example, between about 80 and about 85 psia and to open to allow flow therethrough from the pump 148 any time the pressure in the line downstream from the compressor 166, which leads to the nozzle, drops below this value.

As earlier indicated, the liquid $CO_2$ is expanded at the nozzle 162, turning to snow and vapor with the snow settling downward some 120 feet through the tower 142 to the pool of liquid therebelow in the main tank. Accordingly, while the surface of the liquid in the tank 140 will be at the triple point pressure, the pressure at the expansion nozzle discharge may be about 1 psi lower, which pressure is maintained by the suction of the compressor 166. The excess of liquid is supplied by the pump 148 and diverted through the bypass 156 creates a constant downward flow in the tank 140 from the upper surface which accelerates the gravimetric settling of the snow which forms slush within the tank.

The tank 140 is provided with some sort of monitoring unit, for example, a level control 170 which may be of the photoelectric type, that determines when the slush in the tank has built upward to a maximum desired level. At this point the control system should be actuated to close a valve (not shown) in the line 152, or to turn off the pump 148, and thus momentarily suspend further snow-making. As in the case of the earlier described versions, whenever refrigeration is called for, the pump 148, or a separate pump (not shown), circulates cold liquid $CO_2$ to the load 150. The warm liquid and/or vapor which results from cooling the load is returned through a line 172 to a lower location in the tank 140 where it is condensed and/or re-cooled, resulting in the melting of some of the solid $CO_2$ portion of the slush.

Figure 5:
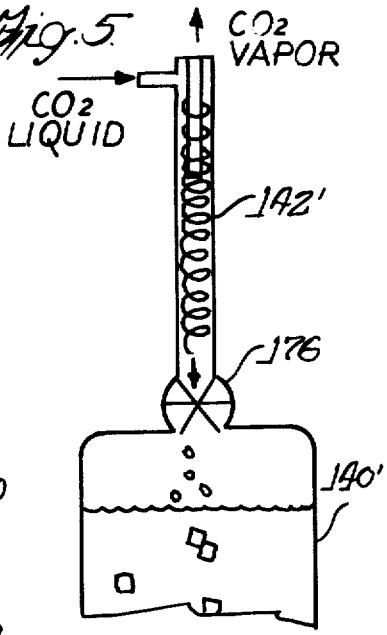
FIG. 5 is a view of another carbon dioxide cooling system embodying various features of the invention.

Depicted in FIG. 5 is an alternative version of the system shown in FIG. 4 which avoids the need for a tower of such height by employing a star valve 176 or its equivalent at the bottom of the tower 142' just above the top of the tank 140'. As a result, the pressure at the top of the tower 142' is isolated from the pressure at the surface of the liquid in the main tank 140', and the compressor may be operated to maintain a somewhat lower pressure at the expansion nozzle to increase the percentage of snow that will be created.

Figure 6:
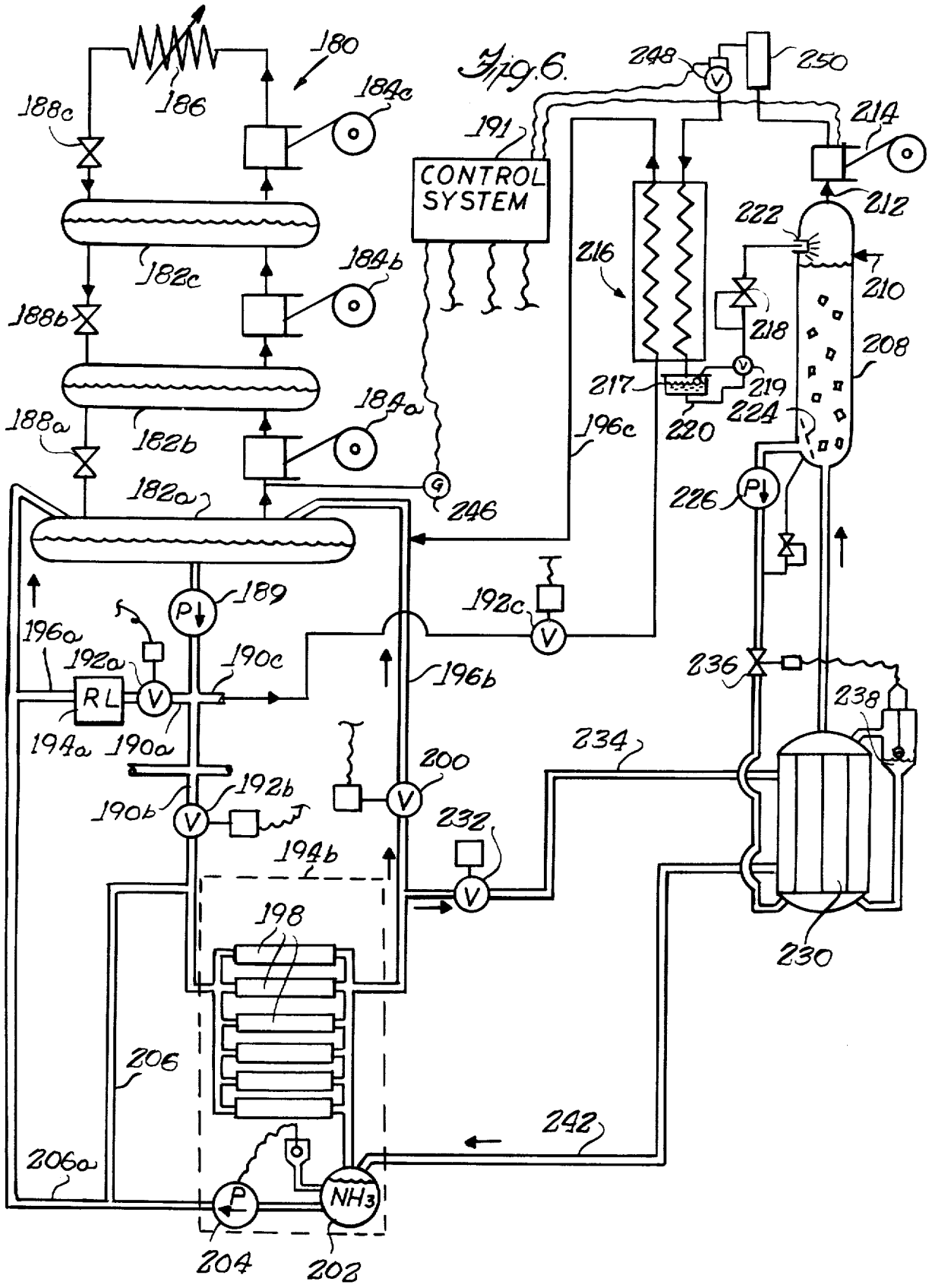
FIG. 6 is a view of another carbon dioxide cooling system including a mechanical refrigeration unit.

Depicted in FIG. 6 is still another alternative version wherein the refrigeration capacity of the slush reservoir is not used to directly absorb heat from material being cooled, but instead it is indirectly employed, i.e., by lowering the operating temperature of an existing mechanical refrigeration system so as to alter its operation in a way to provide cooling at a temperature substantially below its normal refrigeration temperature or to condense the refrigerant of the mechanical system when the system is overloaded or stopped. "By mechanical refrigeration unit or system is meant a system that uses an application of thermodynamics in a cycle in which a refrigerant in liquid form is evaporated to the gas phase at a lower pressure and then recovered for reuse by compression and condensation back to the liquid phase at a higher pressure". Mechanical refrigeration systems in use today in food-freezing plants generally use refrigerants which boil between about −20° F. and about −50° F. at atmospheric pressure, and most operate at a cold side temperature of between about −30° F. and about −40° F. which is frequently achieved by operating at subatmospheric pressure. Such a mechanical refrigeration unit presently in operation can be simply modified to create a lower cold side temperature at its heat-exchange surface, which substantially increases its efficiency of operation and its cooling capacity without physically altering the mechanical refrigeration device itself. A further advantage is that an existing mechanical refrigeration unit can be effectively operated continuously whether or not there is cooling demand, whereas at the present time large compressors are generally run unloaded or with false loads (and thus very inefficiently) during those periods when there is no demand for refrigeration from a freezing tunnel, a cabinet, or the like. By incorporating a slush reservoir into the system, the cooling capability of the mechanical system is shifted, during periods of low or no cooling demand, to assist in the creation of slush that is stored in the holding tank. Consequently, instead of simply wasting electrical power to run large compressor motors continuously while the compressors are unloaded, continuous compressor operation is fully utilized to store refrigeration capacity in the form of $CO_2$ slush during off-peak times.

FIG. 6 illustrates a 3-stage compression, mechanical refrigeration unit 180 of a type which is commercially available and which forms part of the prior art. The illustrated unit is designed to operate using ammonia; however, other refrigerants, e.g, Freon-12 and Freon-22, could be used. The unit 180 includes three liquid-vapor accumulators 182*a,b&c*. A compressor 184*a,b* or *c* draws vapor from one of the accumulators 182, which compressors may be separate stages of a single 3-stage compressor. For example, the valving and sizing of the system may be such as to maintain a vacuum equal to about 10 inches of mercury (i.e., about 10 psia or about ⅔ atm.) within the first accumulator 182*a*. Operation at partial vacuum conditions reduces the temperature below the boiling point at one atmosphere, and the liquid ammonia is at an equilibrium temperature of about −40° F. in the first accumulator 182*a*. The first compressor 184*a* will bubble its discharge into the second accumulator 184*b* which will contain liquid ammonia and vapor in equilibrium at about −5° F., i.e. at about 22 psia. The second compressor 184*b* removes vapor from the second accumulator 182*b*, compresses it and bubbles the compressed vapor through the liquid phase of the third accumulator 182*c* which may be at a temperature of about 30° F., i.e., about 60 psia. The third compressor 184*c* removes vapor from the accumulator 182*c*, and the compressed vapor is liquified in a suitable condenser 186 which may be air or water cooled. The condensed, high-pressure liquid is fed through an expansion valve 188*c* back to the third accumulator 182*c* where it flashes to a liquid-vapor mixture. Liquid ammonia is appropriately metered through expansion valves 188*b* and 188*a*, respectively, from the third accumulator 182*c* to the second accumulator 182*b* and from the second accumulator 182*b* to the first accumulator 182*a* where the −40° F. liquid ammonia is in equilibrium with ammonia vapor at about 10 inches of vacuum.

Liquid ammonia is withdrawn from the third accumulator 182*a*, preferably by a pump 189, and fed through supply lines 190 to achieve low temperature cooling and/or freezing functions in various locations throughout a plant. An overall control system 191 opens remote-controlled valves 192*a,b,c,d* in the liquid supply lines to supply cold ammonia to a particular unit, e.g., valve 192a in line 190a leading to refrigeration load 194a. In each instance, the vapor would be returned to one or more conduits 196a,b leading back to the accumulator 182a.

Diagrammatically illustrated in FIG. 6 is a refrigeration load 194b in the form of an elevator-type, multiple-plate freezer wherein a plurality of heat-exchange plates 198 are each connected in parallel by flexible tubing to a refrigerant supply line 190b which contains a remote control valve 192b. Likewise, the exits from each of the plates connects to a manifold which leads to a vapor return line 196b, which is connected through a remote-control valve 200 to the accumulator 182a. A plate-type freezer 194b of this type is generally operated so that slightly more liquid ammonia will be provided to each plate than will be vaporized, and accordingly the excess liquid ammonia refrigerant will flow downward in the exit manifold to a lower receptable 202 from which it is withdrawn by a small pump 204 that is operated by a liquid level control. The pump 204 recirculates the liquid ammonia through a line 206 leading to the liquid supply line 190b or through a line 206a which leads back to the accumulator 182a.

A thermally insulated $CO_2$ holding tank 208 is provided which is filled to a desired level with liquid $CO_2$ by a supply conduit 210. $CO_2$ vapor is withdrawn through an upper line 212 by a compressor 214, and the compressed vapor flows through a condenser 216. Cold ammonia, at about −40° F., is circulated through a supply line 190c via a remote-controlled valve 192c to the other side of the condenser 216 where it lowers the temperature of the compressed $CO_2$ vapor and liquifies it. Ammonia vapor from the condenser 216 is returned through the line 196c to the accumulator 182a.

A back pressure regulator 218 in a line 220 connecting the $CO_2$ side of the condenser 216 with the holding tank 208 is set to maintain a pressure of at least about 180 psia so that the vapor condenses to liquid at the cooling temperature that is provided by the evaporating ammonia. The liquid $CO_2$ from the condenser 216 is collected in a sump 217 out of which it is allowed to flow via a valve 219 controlled by a liquid level control. The high pressure liquid $CO_2$ is expanded through a nozzle 222 into the holding tank 208 as a mixture of $CO_2$ vapor and $CO_2$ snow. As the temperature within the holding tank 208 is slowly reduced by this refrigeration that is being provided in the condenser 216, the surface of the liquid reaches the triple point, and thereafter $CO_2$ snow which forms at the nozzle 222 remains in the solid form and gravitates downward in the holding tank to create the slush mixture as described in respect of the earlier embodiments. As a result, a reservoir of $CO_2$ slush is built up in the holding tank 208.

A screen 224 near the bottom of the holding tank 208 provides a solid-free region from which a circulating pump 226 draws cold liquid $CO_2$ which will be at a temperature of about −70° F. This cold liquid $CO_2$ is employed to increase the efficiency of the existing ammonia refrigeration system 180, and its operation is illustrated with respect to the plate-type freezer 194b. A suitable heat-exchange unit 230 is provided which is illustrated as a tube-and-shell heat-exchanger. When it is desired to use the stored refrigeration available in the $CO_2$ slush tank 208 to cool the plate-freezer 194b, the valve 200 in the vapor return line 196b is closed, and a valve 232 in a branch line 234 leading to the heat-exchanger 230 is opened. The circulating pump 226 is actuated to withdraw liquid $CO_2$ from the holding tank and pump it into the lower plenum on the tube side of the heat-exchanger 230 when a valve 236 is opened. The valve 236 operates in response to a signal from a liquid level control 238 that maintains the tubes filled to a desired depth with the −70° F. liquid $CO_2$ from the holding tank 208 which vaporizes therein and returns through the overhead line to the slush tank 208 where it is condensed similar to the vapor returning through the line 106 in FIG. 2.

In the heat-exchanger 230, the vaporous ammonia refrigerant, which enters near the top, is condensed and further cooled to reduce its temperature to between about −60° F. and about −65° F., which is equal to a vacuum of about 20 inches of mercury (i.e., about $\frac{1}{3}$ atmosphere absolute). This cold liquid ammonia leaves through a lower exit and flows downward in a line 242 leading to the receptacle 202 from which it is pumped by the pump 204 back into the plate freezer 194b. The receptacle 202 may be sized to contain a sufficient amount of liquid ammonia refrigerant so that the heat-exchanger 230 and the receptacle can be used as a closed system to supply all of the cooling required by the plate freezer 194b. Inasmuch as the ammonia refrigerant being supplied to the plate freezer is now some 20° F. to 25° F. colder than it is during normal operation without the use of the heat-exchanger 230, it is not only capable of reducing the ultimate temperature of the material being frozen but of also increasing the rate at which product can be frozen by the freezer inasmuch as the $\Delta t$ available for heat removal is substantially larger. Preferably, the mechanical refrigerant is cooled to at least about −50° F.

The triple point of the cryogen should be such as to cool the refrigerant significantly below its condensation temperature at its normal operating conditions in order to obtain the full advantage of the invention although a triple point about 10° F. below the condensation temperature could be used. Thus, the cryogen preferably has a triple point between about −50° F. and about −80° F. When ammonia is the refrigerant, it is preferably cooled to at least about −55° F., and carbon dioxide (triple point −70° F.) is the preferred cryogen for use therewith. Moreover, the ability to condense the refrigerant without the expenditure of major amounts of power (e.g., to drive a compressor) allows operation to continue with minimum power usage during peak electrical power periods when its cost might be at a high rate charge.

In addition to being able to increase the efficiency of an existing plate freezer without altering the basic ammonia refrigeration unit 180, the $CO_2$ reservoir system has the further advantage of being able to eliminate other inherent inefficiencies which heretofore resulted from the common practice of running large compressors continuously on hot-gas recycle, or dampened inlet, rather than shutting them down for short periods of time and starting them up again when needed. In the overall embodiment depicted in FIG. 6, the control system 191 is programmed to detect such a reduction in demand upon the unit 180, as by monitoring the suction pressure to the compressor 184a via a gauge 246. When the suction pressure read by the gauge 246 drops below a predetermined lower limit, the control system 191 starts the $CO_2$ compressor 214, opens a valve 248 and opens the valve 192c to supply "excess" liquid ammonia to the condenser 216 so long as it is not needed elsewhere in the refrigeration plant. If it is desired to have the compressor 214 run generally continuously, an accumulator 250 is provided upstream of the valve 248 in which the compressor can build up a reservoir of high-pressure cryogen vapor so that the valve 248 need only be opened when the valve 192c is opened. When the suction pressure read by the gauge 246 rises above a predetermined upper limit, which is indicative that larger refrigeration loads are now demanding refrigerant elsewhere in the plant, the control system 191 closes the valve 192c and the valve 248. The $CO_2$ compressor 214 may also be shut down, or it may be allowed to pump vapor into an accumulator 250. As a result, the 3-stage compressor 184 can be efficiently operated on a continuous basis thus fully utilizing its potential for creating −40° F. ammonia. Of course, whenever refrigerant is being supplied to the condenser 216, additional slush is being created in the holding tank 208 which in turn stands ready as a reservoir of −70° F. coolant for delivery to the heat-exchanger 230 to produce proportionately colder liquid ammonia. Moreover, if more precise control over the suction pressure is desired, modulating valves 192c and 248 may be used so that the control system 191 can maintain a fairly constant suction pressure.

It should, of course, be understood that the use of such colder ammonia is not limited to a plate freezer. It could be similarly employed to create lower temperatures in an air-blast unit or any other commercially available ammonia refrigeration equipment, or it could be employed to chill products by direct heat-exchange. The discharge from the pump 226 could also be split into parallel loops and fed through several heat-exchangers 230, each of which is connected to a separate cooling or freezing unit. Alternatively, one large heat-exchanger 230 may be used, and the condensate may be pumped by the pump 204 to several different freezing units.

Although the invention has been described with respect to certain preferred embodiments, it should be understood that modifications and changes which would be obvious to one having the ordinary skill in the art may be made without deviating from the scope of the invention which is defined solely by the claims appended hereto. For example, although the removal of liquid $CO_2$ and its circulation is illustrated and is preferably used to effect the direct or indirect cooling, an auxiliary stream of heat-exchange liquid could instead be employed. Particular features of the invention are emphasized in the claims that follow.

What is claimed is:

1. A method of refrigerating material using stored cryogenic refrigeration, which method comprises creating a reservoir of solid and liquid cryogen in chamber means by maintaining a temperature and a pressure at about the triple point of said cryogen where solid, liquid and vapor cryogen exist in equilibrium, separating liquid cryogen from solid cryogen in said reservoir and removing said separated liquid cryogen from said chamber means, circulating said removed liquid cryogen to heat-exchange means where it absorbs heat from said material being refrigerated and vaporizes, and returning said cryogen from said heat-exchange means to said chamber means where said absorbed heat is given up by melting said solid cryogen.

2. A method in accordance with claim 1 wherein the pressure of said removed cryogen is raised prior to circulation to the heat-exchange means and wherein the temperature of said higher pressure liquid cryogen is raised above the triple point temperature in said heat-exchange means.

3. A method in accordance with claim 1 wherein solid cryogen is created in said chamber means by withdrawing cryogen vapor therefrom, wherein said withdrawn vapor is compressed to a higher pressure and condensed and wherein said higher pressure condensed liquid cryogen is returned to said chamber means.

4. A method in accordance with claim 1 wherein liquid cryogen from said chamber means is solidified by mechanical refrigeration to create said reservoir of solid cryogen.

5. A method in accordance with claim 4 wherein said solidification takes place in a compartment in said chamber means above the level of liquid.

6. A method in accordance with claim 4 wherein said chamber means includes a pair of interconnected vessels each having evaporation coil means in an upper portion thereof and wherein liquid cryogen is transferred between said vessels to alternately immerse the coil means therein in liquid cryogen.

7. A method in accordance with claim 1 wherein said solid cryogen reservoir is created by withdrawing liquid cryogen, expanding said liquid cryogen to create a mixture of snow and vapor, transferring said snow to said chamber means, and compressing and condensing said vapor to high pressure liquid cryogen.

8. Refrigeration apparatus for cooling material using stored cryogenic refrigeration, which apparatus comprises thermally insulated chamber means, means for supplying said chamber means with cryogen, means associated with said chamber means for creating a reservoir of solid and liquid cryogen in said chamber means at or near the triple point where solid, liquid and vapor exist in equilibrium, and means for separating liquid cryogen from said reservoir of solid cryogen, removing said liquid cryogen from said chamber, circulating said removed liquid cryogen exterior of said chamber to heat-exchange means, vaporizing said circulating liquid cryogen by absorbing heat from material being cooled and then removing said absorbed heat from said cryogen vapor by melting solid cryogen in said reservoir in said chamber means.

9. Apparatus in accordance with claim 8 wherein means is provided for raising the pressure of said removed liquid cryogen.

10. Apparatus in accordance with claim 9 wherein a tower is provided which surmounts said chamber means and wherein means is provided for expanding at least a portion of said higher-pressure removed liquid cryogen to form a mixture of snow and vapor in an upper region of said tower.

11. Apparatus in accordance with claim 10 wherein means is provided for withdrawing cryogen vapor from said upper region of said tower and for compressing said withdrawn vapor to a higher pressure, wherein means is provided for condensing said higher pressure cryogen vapor, and wherein means is provided for returning said condensed cryogen to said expanding means.

12. Apparatus in accordance with claim 9 wherein means is provided for expanding liquid cryogen to form a mixture of vapor plus particulate solids in a zone isolated from said chamber means and for separating the solids from the vapor, wherein means is provided for transferring at least a portion of said higher pressure removed liquid cryogen to said expanding means, and wherein means is provided for returning said separated particulate solids to said chamber means.

13. Apparatus in accordance with claim 8 wherein mechanical refrigeration means is provided for removing heat from liquid cryogen from said chamber means to solidify same and to thereby create said reservoir of solid cryogen.

14. Apparatus in accordance with claim 13 wherein said mechanical refrigeration means includes a cube-making device located in said chamber means above the level of liquid, and wherein means is provided for supplying said device with liquid cryogen.

15. Apparatus in accordance with claim 13 wherein said chamber means includes a pair of interconnected vessels, wherein evaporation coil means is provided in an upper portion of each vessel which forms a part of said mechanical refrigeration means, and wherein means is provided for transferring liquid cryogen between said vessels to alternately immerse said coil means therein in liquid cryogen.

16. Apparatus in accordance with claim 8 wherein a mechanical refrigeration unit employing a fluid refrigerant is provided which supplies refrigerant in liquid form to a refrigeration load where it is evaporated, wherein means is provided for withdrawing refrigerant vapor from an outlet from said refrigeration load and for condensing said withdrawn vapor and cooling same to a temperature of at least about −50° F. utilizing said solid cryogen reservoir, and wherein means is provided for supplying said cooled refrigerant in liquid form to said refrigeration load.

17. Refrigeration apparatus using stored cryogenic refrigeration, which apparatus comprises thermally insulated chamber means, means for supplying said chamber means with cryogen, means associated with said chamber means for creating a reservoir of solid cryogen in said chamber means at or near the triple point where solid, liquid and vapor exist in equilibrium, a mechanical refrigeration unit employing a fluid refrigerant which is normally supplied to a refrigeration load in liquid form at a first temperature and evaporated, means for employing the stored refrigeration in said reservoir of solid cryogen to condense the refrigerant following evaporation at said refrigeration load and to cool said condensed refrigerant to a second temperature which is lower than said first temperature, and means for returning said condensed refrigerant to said refrigeration load at a temperature below said first temperature for another pass therethrough.

18. Apparatus in accordance with claim 17 wherein heat-exchange is included, wherein means is provided for withdrawing a stream of liquid cryogen from said chamber means, passing the stream through said heat-exchange means and returning the stream to said chamber means, and wherein means is provided for supplying the evaporated refrigerant to said heat-exchange means and for removing cooled liquid refrigerant from said heat-exchange means.

19. Apparatus in accordance with claim 18 wherein said reservoir is solid $CO_2$, wherein said heat-exchange means comprises a vertically disposed tube and shell heat-exchanger, and wherein means is provided for controlling the depth of liquid cryogen within the tubes of said heat-exchanger.

20. Apparatus in accordance with claim 17 wherein means is provided for detecting a reduction in demand upon said mechanical refrigeration unit by said refrigeration load, wherein a compressor and a condenser are provided for removing cryogen vapor from said chamber means and form a part of said solid-cryogen-creating means, and wherein control means is provided for automatically supplying refrigerant and compressed cryogen vapor to said cryogen vapor condenser whenever such a reduction in demand is detected by said detecting means.

21. Apparatus in accordance with claim 20 wherein said mechanical refrigeration unit includes refrigerant compressor means, and wherein said detection means is adapted to monitor the suction pressure of said refrigerant compressor means and automatically supply said refrigerant and said compressed cryogen vapor when said suction pressure drops below a predetermined lower limit.

22. Apparatus in accordance with claim 21 wherein said control means is also adapted to decrease supply of said refrigerant and said compressed cryogen vapor when said suction pressure being detected rises above a predetermined upper limit.

23. A refrigeration method for supplying refrigeration over an extended period to a refrigeration load varying in size, which method comprises employing a mechanical refrigeration unit to cool a refrigeration load by circulating a liquid refrigerant to said load where said refrigerant evaporates, recovering and condensing said evaporated refrigerant, establishing a reservoir of solid cryogen in equilibrium with liquid cryogen and cryogen vapor at or near the triple point within thermally insulated chamber means, diverting excess liquid refrigerant from said mechanical refrigeration unit to a first condenser, withdrawing cryogen vapor from said chamber means, compressing said vapor and supplying said compressed vapor to said first condenser to form liquid cryogen at a pressure above said triple point pressure, returning said higher pressure liquid cryogen to said chamber means via expansion means, whereby additional solid cryogen is formed, periodically diverting evaporated refrigerant from said mechanical refrigeration unit to a second condenser, condensing said diverted refrigerant therein, in a manner which results in melting solid cryogen in said reservoir, and returning said condensed diverted refrigerant to said refrigeration load.

24. A method in accordance with claim 23 wherein said refrigerant has a boiling point between about −20°

F. and about −40° F. at one atmosphere and said cryogen has a triple point between about −30° F. and about −80° F., said triple point being below said boiling point at the pressure at which said condensation occurs.

25. A method in accordance with claim 24 wherein said cryogen is carbon dioxide.

26. A method in accordance with claim 23 wherein whenever a reduction in the refrigeration load demand upon said mechanical refrigeration unit below a certain limit is detected, in response to said detection compressed cryogen vapor from said chamber means is automatically supplied to a condenser and refrigerant is also supplied to the condenser whereby high pressure liquid cryogen is supplied from the condenser to be used in creating said solid cryogen reservoir.

27. A method in accordance with claim 26 wherein said reduction in refrigeration load is detected by monitoring the suction pressure of the refrigerant compressor of said mechanical refrigeration unit.

28. A method in accordance with claim 23 wherein said refrigerant has a boiling point between about −20° F. and about −40° F. at one atmosphere and wherein said cryogen has a triple point between about −30° F. and about −80° F.

29. A method in accordance with claim 28 wherein said diverted evaporated refrigerant, in said second condenser means, passes in heat-exchange relationship with liquid cryogen withdrawn from said chamber means which vaporizes therein and wherein said cryogen vapor is returned to said chamber means where it recondenses by melting said solid cryogen.

30. A method in accordance with claim 28 or claim 29 wherein said cryogen is carbon dioxide.

31. A refrigeration method using stored cryogenic refrigeration, which method comprises creating a reservoir of solid cryogen in equilibrium with liquid cryogen and cryogen vapor in thermally insulated chamber means at or near the triple point, employing a mechanical refrigeration unit to cool a refrigeration load by circulating a liquid refrigerant at a normal first temperature to said load where said refrigerant evaporates, periodically diverting evaporated refrigerant from said mechanical refrigeration unit and cooling and condensing said diverted refrigerant to a second temperature near or below said first temperature by employing the stored refrigeration in said reservoir of solid cryogen, and returning said condensed liquid refrigerant to said refrigeration load at a temperature near or below said normal first temperature.

* * * * *